US009293804B2

(12) United States Patent
Mailandt et al.

(10) Patent No.: US 9,293,804 B2
(45) Date of Patent: Mar. 22, 2016

(54) INTEGRATED ANTENNA SYSTEM FOR A TRAIN CONTROL SYSTEM

(71) Applicant: dbSpectra, Inc., Lewisville, TX (US)

(72) Inventors: Peter Mailandt, Dallas, TX (US); Lalit N. Raina, Richardson, TX (US); Divyesh Patel, Frisco, TX (US); Eddie Soulatha, Grand Prairie, TX (US)

(73) Assignee: DBSPECTRA, INC., Lewisville, TX (US)

( * ) Notice: Subject to any disclaimer, the term of this patent is extended or adjusted under 35 U.S.C. 154(b) by 410 days.

(21) Appl. No.: 13/850,200

(22) Filed: Mar. 25, 2013

(65) Prior Publication Data

US 2014/0285390 A1 Sep. 25, 2014

(51) Int. Cl.

| | |
|---|---|
| ***H01Q 21/00*** | (2006.01) |
| ***H01Q 1/12*** | (2006.01) |
| ***H01Q 3/04*** | (2006.01) |
| ***H01Q 25/00*** | (2006.01) |

(52) U.S. Cl.

CPC ..... *H01Q 1/1228* (2013.01); *H01Q 3/04* (2013.01); *H01Q 25/005* (2013.01)

(58) Field of Classification Search

USPC ..... 343/793, 810, 890, 891

See application file for complete search history.

(56) References Cited

U.S. PATENT DOCUMENTS

| | | | | |
|---|---|---|---|---|
| 2,804,618 | A * | 8/1957 | Carpenter | 343/814 |
| 3,248,736 | A * | 4/1966 | Bohar | 343/797 |
| 4,180,820 | A * | 12/1979 | Johns | 343/798 |
| 5,237,336 | A * | 8/1993 | Jelloul | 343/799 |
| 7,119,757 | B1 * | 10/2006 | Lopez | 343/816 |
| 2002/0084949 | A1 * | 7/2002 | Skalina et al. | 343/891 |

* cited by examiner

*Primary Examiner* — Tan Ho

(57) ABSTRACT

An antenna includes a first radiating array coupled to the mast and a second radiating array coupled to the mast. Each of the first and second radiating arrays comprises a plurality of dipoles associated with a radiation frequency, each dipole coupled to the mast by a standoff. The two arrays are mounted approximately opposite to each other relative to the mast, rather than one array on top of the other array. The antenna may be part of a Positive Train Control (PTC) system and be disposed in proximity to a train track.

20 Claims, 10 Drawing Sheets

160 MHz Dipoles rotate around the Mast

INTEGRATED ANTENNA SYSTEM FOR A TRAIN CONTROL SYSTEM

TECHNICAL FIELD OF THE INVENTION

The present disclosure relates generally to train control systems and, more specifically, to an improved integrated antenna system for a Positive Train Control system.

BACKGROUND OF THE INVENTION

Positive Train Control (PTC) is a system of functional requirements for monitoring and controlling train movements for the purpose of separating trains on the same track, avoiding collisions of trains, enforcing speed requirements and speed restrictions, and protecting railroad workers, such as maintenance of way workers, bridge workers, and signal maintainers. PTC systems also monitor and control unauthorized incursions by trains, prevent train movements through switches left in the wrong position, warn of upcoming obstructions, and sometimes take control of train movements, such as bringing the train to a stop if necessary.

Prior to October 2008, PTC systems were voluntarily installed by a number of rail carriers. The Rail Safety Improvement Act of 2008 (RSIA) has mandated the widespread installation of PTC systems by the end of 2015.

SUMMARY OF THE INVENTION

In accordance with one embodiment, an antenna for use in a Positive Train Control (PTC) system is provided. The antenna includes a first radiating array coupled to the mast and a second radiating array coupled to the mast. Each of the first and second radiating arrays comprises a plurality of dipoles associated with a radiation frequency, each dipole coupled to the mast by a standoff.

In accordance with another embodiment, an antenna is provided. The antenna includes a mast and a 160 MHz array coupled to the mast and comprising a plurality of 160 MHz dipoles coupled to the mast by a standoff. The antenna also includes a 220 MHz array coupled to the mast and comprising a plurality of 220 MHz dipoles coupled to the mast by a standoff.

In accordance with another embodiment, a positive train control system is provided. The positive train control system includes a plurality of antennas positioned along a railroad track. The positive train control system also includes at least one base station coupled to the antennas, the at least one base station configured to communicate with train equipment and with a remote train monitoring center. Each of the antennas includes a first radiating array coupled to the mast and a second radiating array coupled to the mast. Each of the first and second radiating arrays comprises a plurality of dipoles associated with a radiation frequency, each dipole coupled to the mast by a standoff.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; and the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

Figure 1:
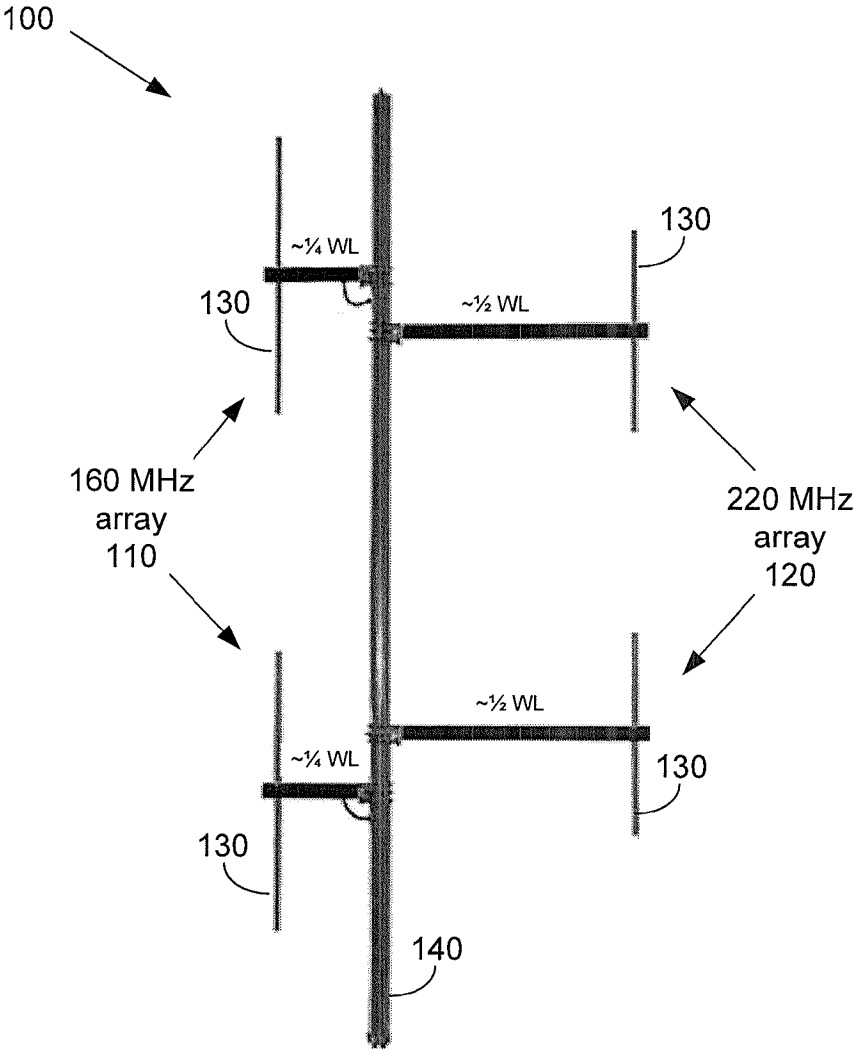
FIG. 1 illustrates an antenna with two radiating arrays, according to an embodiment of this disclosure.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged wireless network.

Some Positive Train Control (PTC) systems include one or more base stations positioned along the railroad tracks. The base stations, which are typically placed on or off of the railroad's right of way, have one or two antennas depending on the communication requirement. One of the antennas is configured to cover the 220 MHz band and maintain communication among the locomotives. This antenna also provides and maintains links between the locomotives and equipment external to the locomotives, such as fault detection monitors, maintenance crews and control stations. These signals typically are then communicated by land lines, microwave, or satellite to the regional and/or national control/monitoring centers of each individual railroad.

The second antenna is configured to cover the 160 MHz frequency band. This antenna is also installed at the base stations and provides a mobile voice communication link between the locomotives and the communication center, as well as voice communication between auxiliary equipment such as by-rail vehicles that monitor track conditions and integrity.

In many systems, coverage of these two frequency bands is provided by using two towers installed along the track, one tower for the antenna providing 220 MHz data communication between the train and the control center, and a separate tower for the antenna providing voice communication via the 160 MHz frequency band. This two-tower approach is expensive for the railroads, not only in that two individual towers are required, but two locations have to be identified, and two foundations have to be laid and maintained.

In other systems, coverage of these two frequency bands is provided by using one tower installed along the track, where the antenna providing 220 MHz data communication between the train and the control center is mounted above or below the antenna providing voice communication via the 160 MHz frequency band. This approach is also not optimal for the railroads, because the antenna height is approximately 20 feet or greater, and wind loading is substantially increased, particularly in severe icing condition. Furthermore, wind will exert lateral pressure on the higher antenna, thereby causing the antennas' patterns to rise and fall below the horizon, generating inconsistent coverage up and down the rail road track to the detriment of the system's performance.

Embodiments of the present disclosure provide an antenna system that utilizes one single tower and an integrated two-antenna system that limits the total height to 10-11 feet for two 5 dBd gain antennas. On the tower, the radiation centers of both antennas are on approximately the same horizontal plane. The single tower eliminates the requirement for multiple towers, multiple locations, multiple foundations, and additional maintenance and security.

FIG. 1 illustrates an antenna with two radiating arrays, according to an embodiment of this disclosure. The embodiment of antenna 100 illustrated in FIG. 1 is for illustration only. Other embodiments of antenna 100 could be used without departing from the scope of this disclosure.

As shown in FIG. 1, antenna 100 includes two radiating arrays: a 160 MHz array, identified by reference number 110, and a 220 MHz array, identified by reference number 120. In other embodiments, more than two radiating arrays could be included.

Each of the two arrays 110, 120 has two dipoles 130. Each dipole 130 is coupled to a standoff or support arm at a distinct distance from the mast 140. The two arrays 110, 120 are mounted approximately opposite to each other relative to the mast, rather than one array on top of the other array. This allows the standoffs of array 110 to be in approximately the same horizontal plane as the standoffs of array 120 (with a small separation to account for the connecting hardware). Since the arrays 110, 120 are not stacked on top of each other (e.g., array 110 is not positioned above array 120, or vice versa), a shorter mast 140 can be used for antenna 100.

The dipoles 130 of the 160 MHz array 110 are at a distance from the mast 140 approximately equal to ¼ wavelength of a 160 MHz signal (i.e., approximately 18 inches). The ¼ wavelength distance is associated with an offset radiation pattern, as described in greater detail below. The dipoles 130 of the 220 MHz array 120 are at a distance from the mast 140 approximately equal to ½ wavelength of a 220 MHz signal (i.e., approximately 27 inches). The ½ wavelength distance is associated with a bi-directional radiation pattern, as described in greater detail below.

Figure 2:
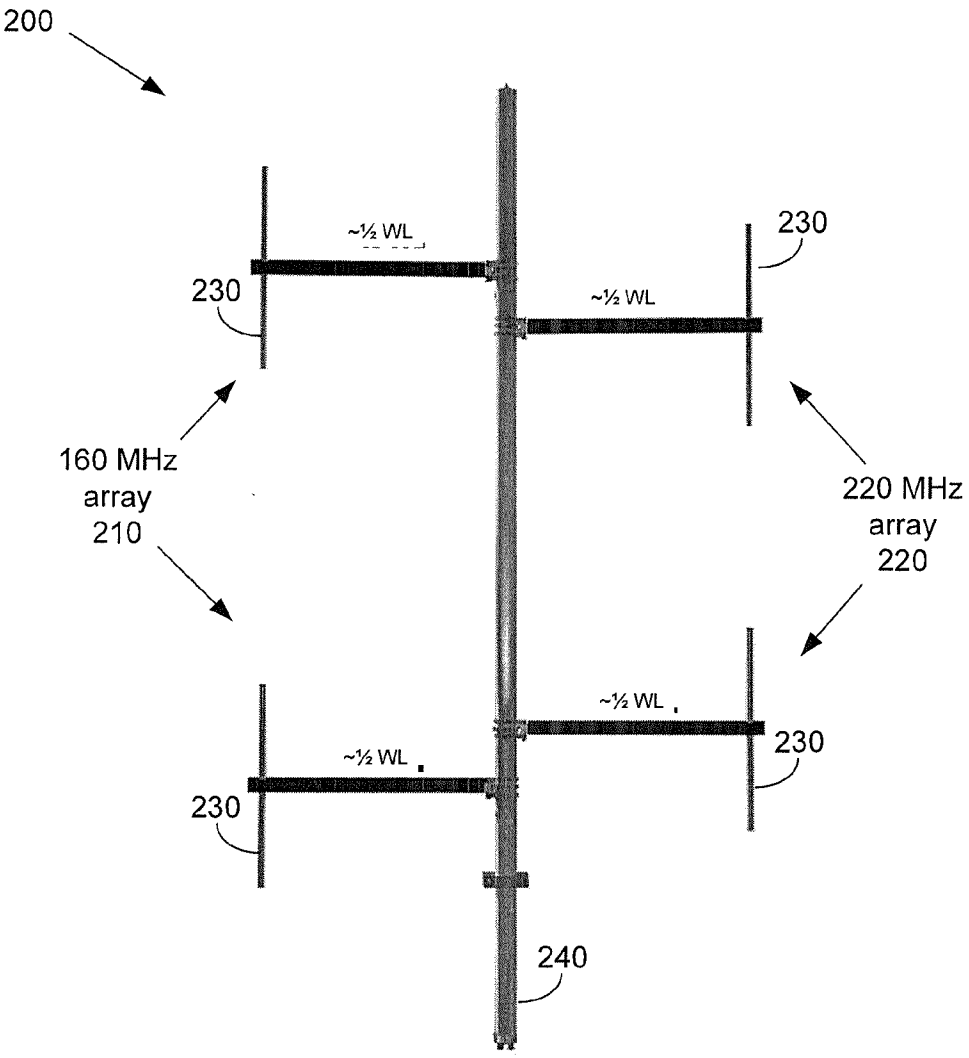
FIG. 2 illustrates an antenna with two radiating arrays, according to another embodiment of this disclosure.

FIG. 2 illustrates an antenna with two radiating arrays, according to another embodiment of this disclosure. The embodiment of antenna 200 illustrated in FIG. 2 is for illustration only. Other embodiments of antenna 200 could be used without departing from the scope of this disclosure.

Similar to antenna 100, antenna 200 includes two radiating arrays: a 160 MHz array, identified by reference number 210, and a 220 MHz array, identified by reference number 220. In other embodiments, more than two radiating arrays could be included.

Each of the two arrays 210, 220 has two dipoles 230. Each dipole 230 is coupled to a standoff or support arm at a distinct distance from the mast 240. The two arrays 210, 220 are mounted approximately opposite to each other relative to the mast, rather than one array on top of the other array. This allows the standoffs of array 210 to be in approximately the same horizontal plane as the standoffs of array 220 (with a small separation to account for the connecting hardware). Since the arrays 210, 220 are not stacked on top of each other, a shorter mast 240 can be used for antenna 200.

The dipoles 230 of the 220 MHz array 220 are at a distance from the mast 240 approximately equal to ½ wavelength of a 220 MHz signal (i.e., approximately 27 inches). The dipoles 230 of the 160 MHz array 210 are at a distance from the mast 240 approximately equal to ½ wavelength of a 160 MHz signal (i.e., approximately 37 inches). The ½ wavelength distances are associated with a bi-directional radiation pattern, as described in greater detail below.

Figure 3:
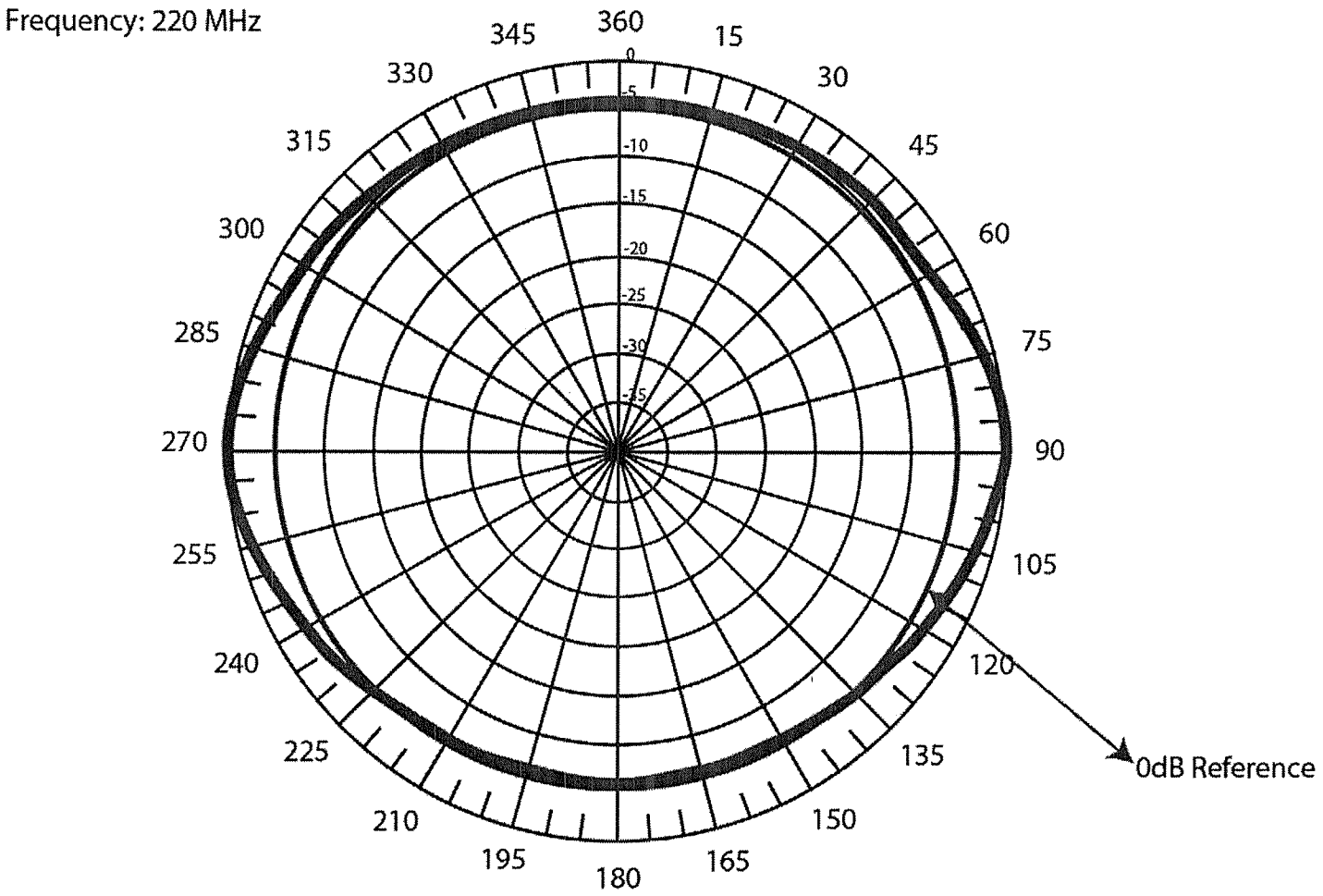
FIG. 3 illustrates a horizontal radiation pattern of the 220 MHz array of FIG. 1 and the 160 MHz and 220 MHz arrays of FIG. 2, according to an embodiment of this disclosure.

FIG. 3 illustrates a horizontal radiation pattern of the 220 MHz array of FIG. 1 and the 160 MHz and 220 MHz arrays of FIG. 2, according to an embodiment of this disclosure. Other embodiments depicted in FIG. 3 could be used without departing from the scope of this disclosure.

The horizontal radiation pattern shown in FIG. 3 is for an array of vertical dipoles mounted approximately ½ wavelength distance from a mast, such as the 160 MHz array 210 and the 220 MHz arrays 120, 220. The horizontal radiation pattern of the array shown in FIG. 3 is characterized as bi-directional. There is a marked increase in signal strength around the 90 degree and 270 degree directions. The bi-directional pattern is characteristic for dipoles positioned at ½ wavelengths away from the mast. The mast to which the dipoles are attached acts as a parasitic element (i.e., a quasi-radiating element).

When such a radiating array is mounted along a railroad wayside with the dipole standoffs orthogonal to the train track, the bi-directional peaks at approximately 90 degrees and 270 degrees cause the radiation pattern to be maximized along the railroad track. It is noteworthy that the radiation pattern is virtually identical with respect to track coverage whether the dipoles are on the trackside of the mast or on the opposite side, i.e., pointing away from the tracks.

A number of such antennas may be positioned at intervals along the train track. When the signal strength at one antenna reduces below a certain threshold level somewhere at a distance from the antenna, or because of a curve in the track or track elevation changes, the communication to the train will be handled by a similar tower some distance down the track.

Figure 4:
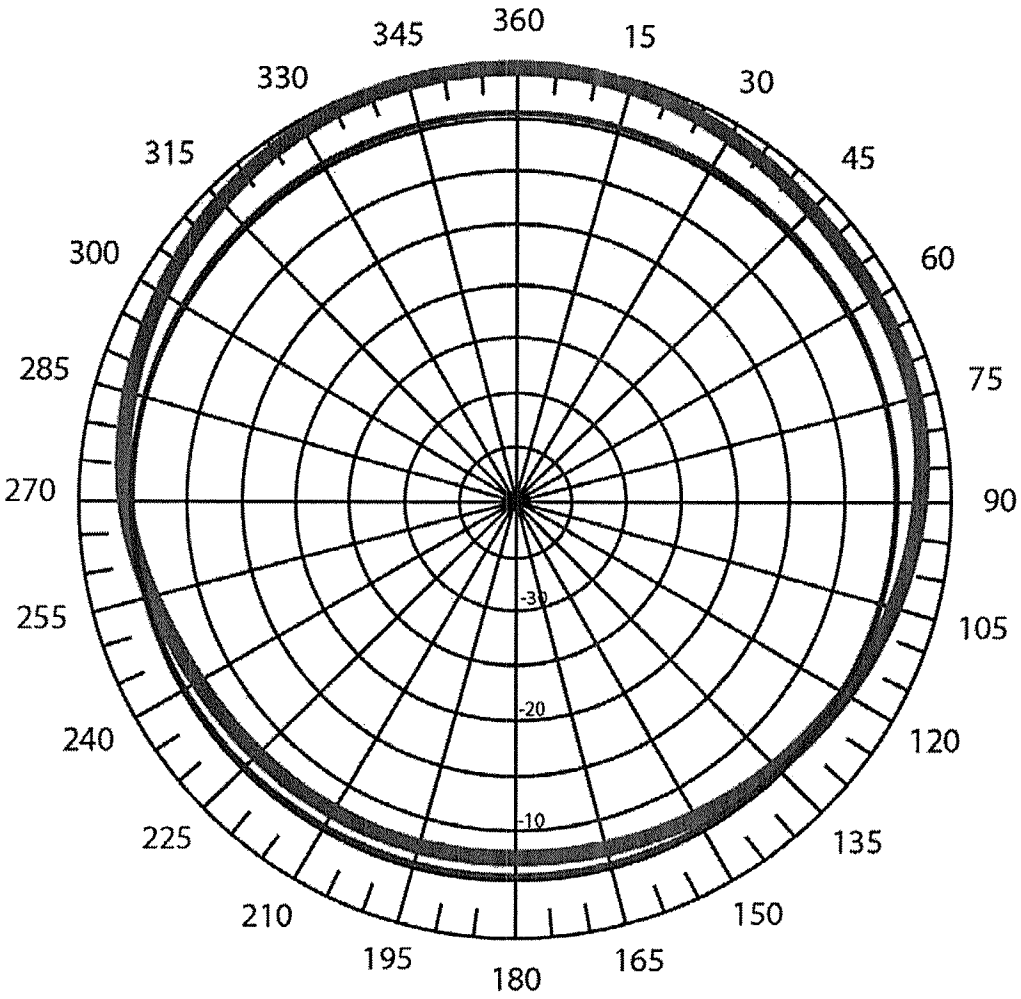
FIG. 4 illustrates a horizontal radiation pattern of the 160 MHz array of FIG. 1, according to an embodiment of this disclosure.

FIG. 4 illustrates a horizontal radiation pattern of the 160 MHz array of FIG. 1, according to an embodiment of this disclosure. Other embodiments of the 160 MHz array depicted in FIG. 4 could be used without departing from the scope of this disclosure.

In contrast to the radiation pattern shown in FIG. 3, the horizontal radiation pattern of the 160 MHz array in FIG. 4 is characterized by a prevailing direction away from the mast (e.g., at the 360 degree direction). The mast, in the case of FIG. 1, acts as a reflector, causing the offset pattern shown in FIG. 4. In many instances, the 160 MHz band is used for voice communication between the wayside and the train, as well as between the wayside and a PTC user that may be a considerable distance away from the track. To cover this considerable distance, the offset pattern of the 160 MHz array of FIG. 1 provides an optimum communication link.

Figure 5A:
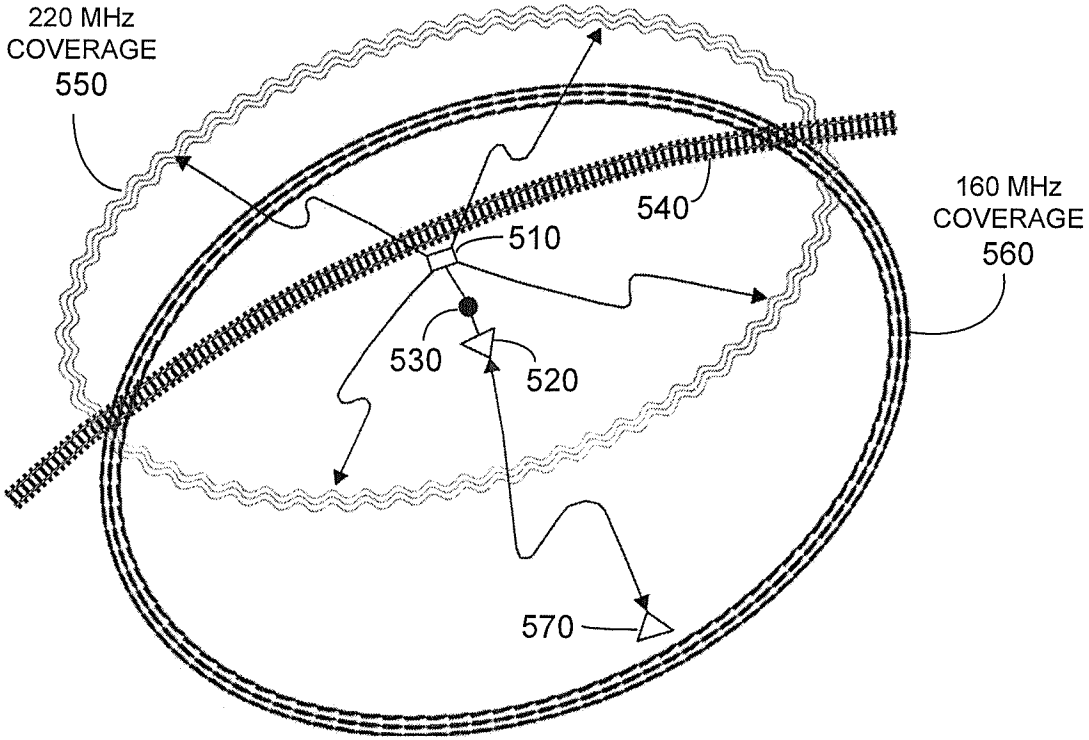
FIGS. 5A and 5B illustrate RF coverage of an antenna along a track, according to embodiments of this disclosure.
Figure 5B:
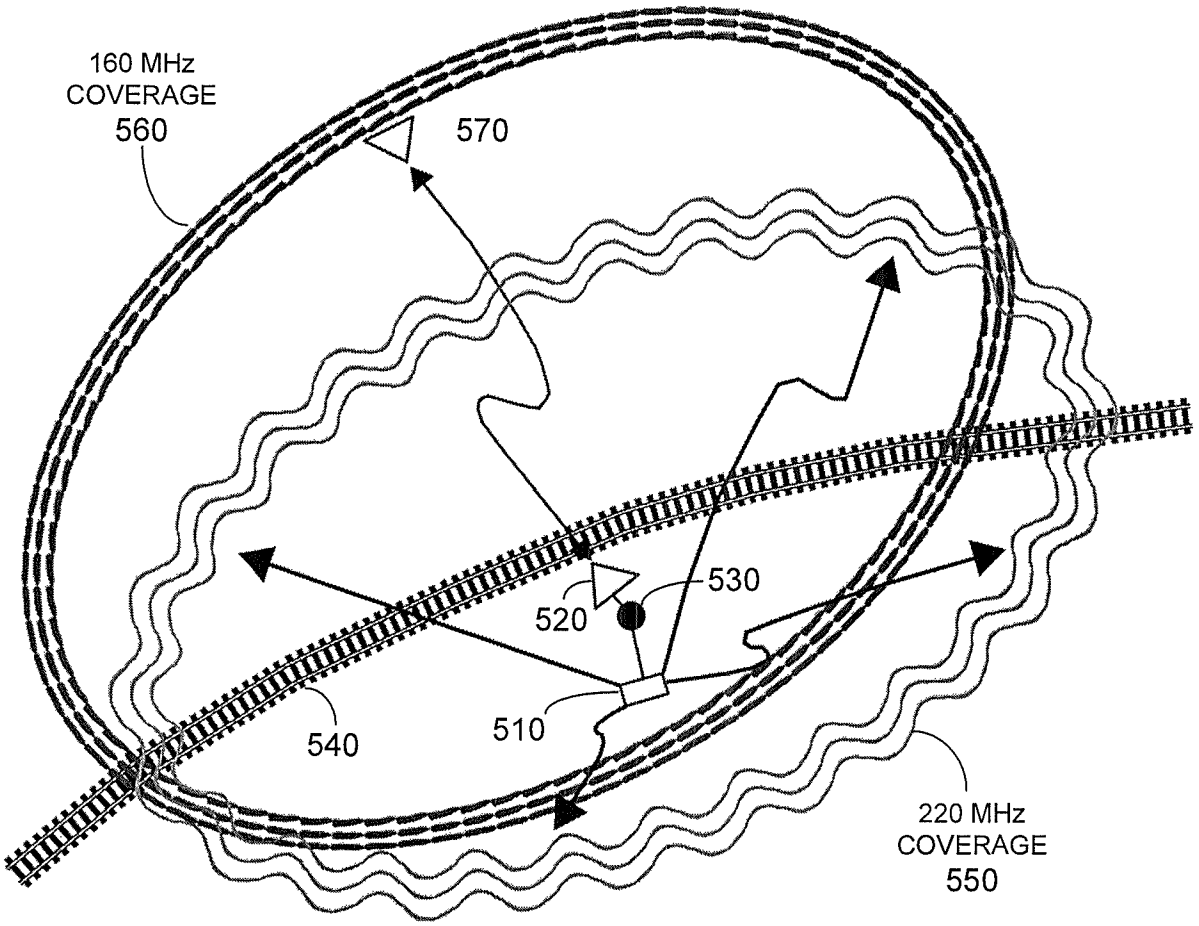

FIGS. 5A and 5B illustrate RF coverage of an antenna positioned along a track, according to embodiments of this disclosure. The embodiments depicted in FIGS. 5A and 5B are for illustration only. Other embodiments could be used without departing from the scope of this disclosure.

As shown in FIG. 5A, a 220 MHz array 510 and a 160 MHz array 520 are coupled to a mast 530 along a track 540. The 220 MHz array 510 is directed toward the track 540 and provides a RF coverage area 550 that maximizes a portion of the track 540. The 160 MHz array 520 points away from the track 540, thereby providing a coverage area 560 that extends to reach an off-track 160 MHz communication location 570 away from the track 540.

In FIG. 5B, the 220 MHz array 510 points away from the track 540. The 160 MHz array 520 is directed towards the track 540 and has a coverage area 560 that reaches an off-track 160 MHz communication location 570 on the opposite side of the track 540.

It is noted that, because of its lower frequency, the 160 MHz signal reaches further than the 220 MHz signal, assuming the same antenna input power and the same antenna gain. In certain embodiments, over a given distance, the 160 MHz signal is about 3 db stronger than the 220 MHz signal. This means that the 160 MHz signal reaches approximately 37% further than the 220 MHz signal, assuming the terrain and track path allows for maximum coverage. In an embodiment, the 160 MHz array 520 does not need to be directed with its maximum signal strength toward the train track 540 (such as shown in FIG. 5B) in order to provide communication links comparable to the 220 MHz signal. Instead, the 160 MHz signal maximum can be directed towards an off-track communication point (e.g., communication location 570) without losing the 160 MHz voice link to the trains and its equivalence to the 220 MHz data signal (such as shown in FIG. 5A).

Figure 6A:
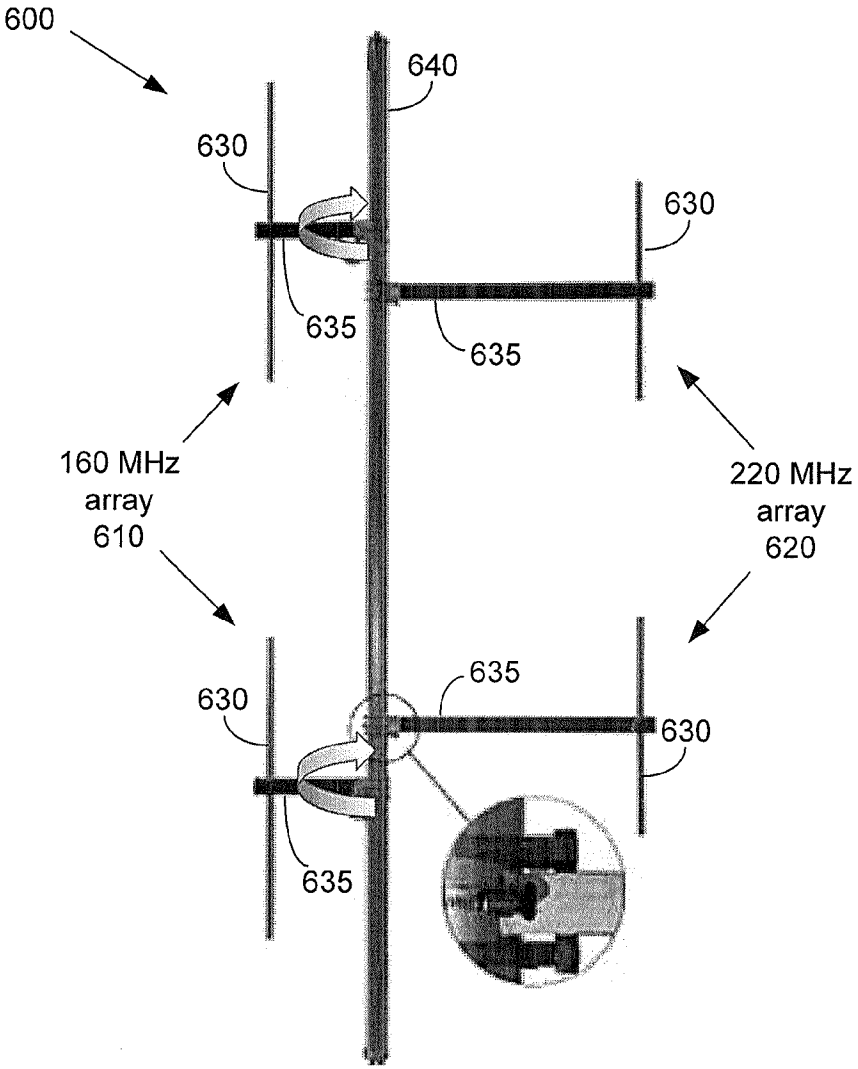
FIGS. 6A and 6B illustrate a flexible deployment of a 160 MHz array, according to an embodiment of this disclosure.
Figure 6B:
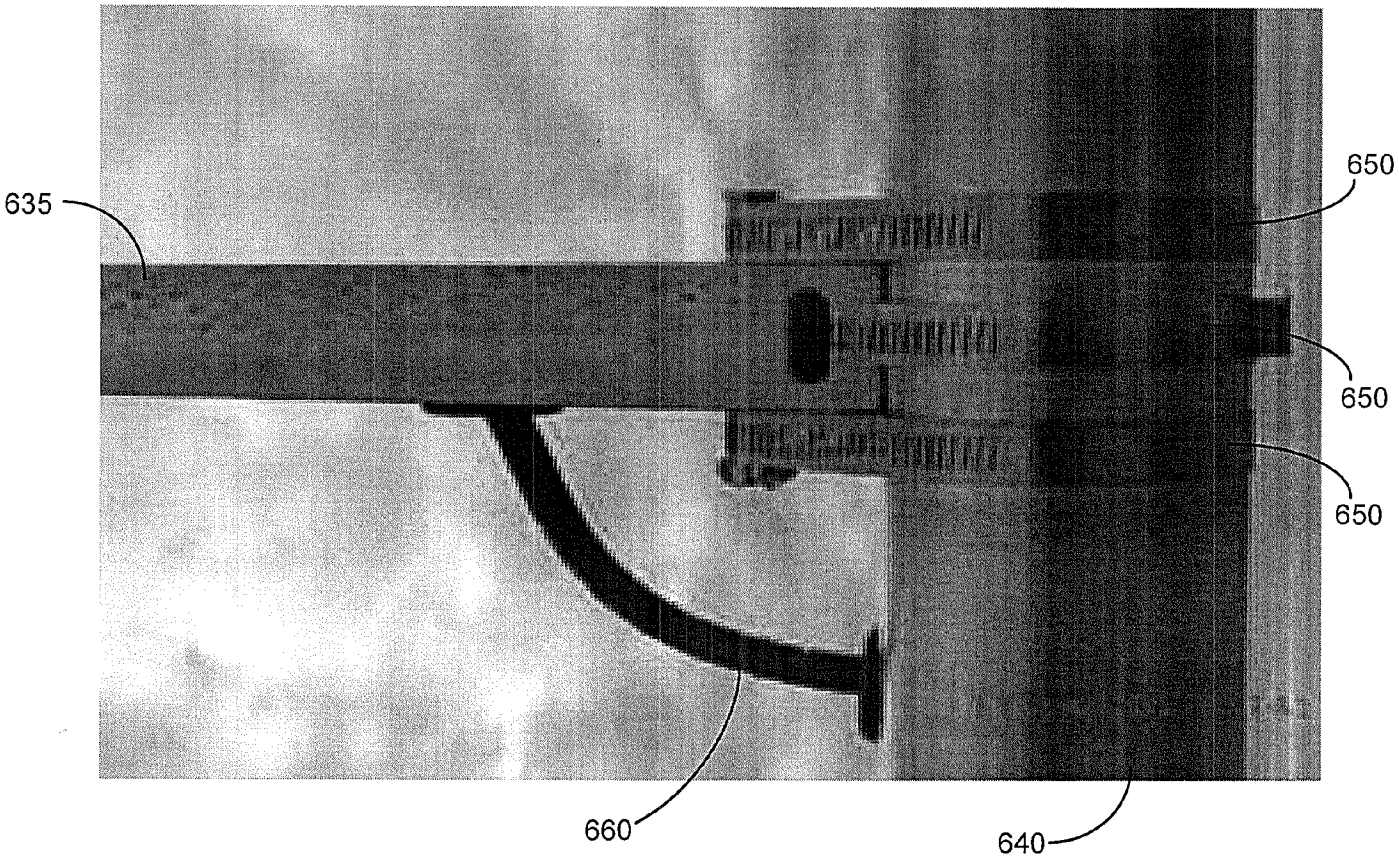

FIGS. 6A and 6B illustrate a flexible deployment of a 160 MHz array, according to an embodiment of this disclosure. The embodiment of antenna 600 illustrated in FIGS. 6A and 6B is for illustration only. Other embodiments of antenna 600 could be used without departing from the scope of this disclosure.

Similar to antenna 100, antenna 600 includes two radiating arrays, a 160 MHz array, identified by reference number 610, and a 220 MHz array, identified by reference number 620. Each of the two arrays 610, 620 has two dipoles 630. Each dipole 630 is coupled to a standoff or support arm 635 at a distinct distance from the mast 640.

To provide an optimum 160 MHz communication link between the 160 MHz base station and a voice communications center away from the track, the antenna 600 provide for flexible deployment of the 160 MHz array 610. The standoffs 635 of the 160 MHz array 610 are fastened to the mast 640 by means of three band clamps 650, as shown in FIG. 6B. The band clamps 650 allow the 160 MHz array 610 to be rotated about the mast 640 (as indicated by the arrows in FIG. 6A) to optimize communication to an off-track site. The slack of the feed harness 660 at the intersection of the mast 640 and the 160 MHz dipole standoff 635 allows the operator to rotate the 160 MHz dipoles about the mast 640 up to approximately 90 degrees in either direction relative to the 220 MHz dipole standoffs 635.

Extensive tests have shown that the 160 MHz radiation patterns are not affected by the 220 MHz array and vice versa as long as an approximately 90-degree angle is maintained between the 160 MHz dipole standoff and the 220 MHz dipole standoff. This indicates that the two arrays do not "see" each other so as to affect each radiation pattern. Also, the return loss or voltage standing wave ratio (VSWR) of each array is substantially unaffected by the presence of the other array as long as the angle between the standoffs in the two arrays equals or exceeds 90 degrees. The antenna 600 in FIGS. 6A and 6B takes advantage of this radiation independence, subject to the proper angular separation, between the 220 MHz array 620 and the 160 MHz array 610.

Figure 7:
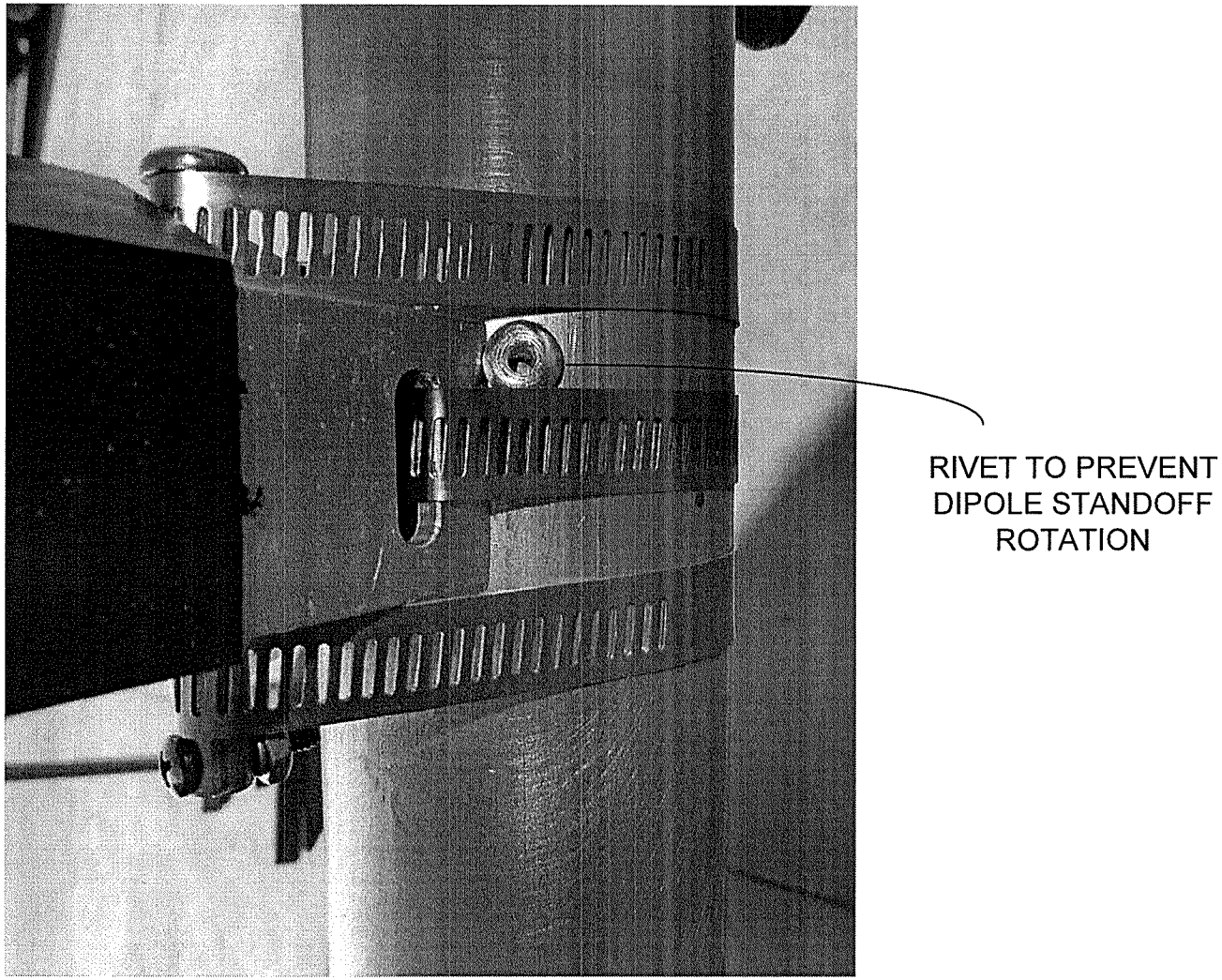
FIG. 7 illustrates a rivet used to prevent dipole rotation, according to an embodiment of this disclosure.

In another embodiment, both the 220 MHz dipoles and the 160 MHz dipoles are positioned approximately ½ wavelength from the mast, such as shown in FIG. 2. The effect of this arrangement is that both radiating arrays provide their maximum radiation up and down the railroad track, such as shown in FIG. 5B. This arrangement is preferred when 160 MHz communications are limited to the trackside location only. In this embodiment, the dipoles of 160 MHz array cannot be rotated. No slack is provided in the feed line, and a rivet (such as shown in FIG. 7) or another fastener on both sides of the dipole standoffs prevents unintended rotation of the 160 MHz array about the mast. Rivets may also be employed to prevent rotation of the dipoles of the 220 MHz array, such as shown in FIG. 6A.

The attachment of the 220 MHz and 160 MHz standoffs 635 with band clamps 650 provides several advantages over a welded attachment. One advantage is the flexibility of deployment of the 160 MHz array 610 towards the optimum direction of required communication. Another advantage is the avoidance of a weld in the high stress area interfacing the dipole standoff 635 and the mast 640. This is particularly important in a high wind-loading situation resulting from very high wind speeds, severe icing conditions, or both.

Likewise, the rivets allow tiny individual movements of the band clamps and standoffs without breakage. In contrast, possible breakage of an aluminum weld would likely generate intermodulation effects that could significantly interfere with the proper workings of the PTC system. In extensive tests, the embodiments employing the band clamps have proven to maintain the physical integrity of the radiating array.

Figure 8:
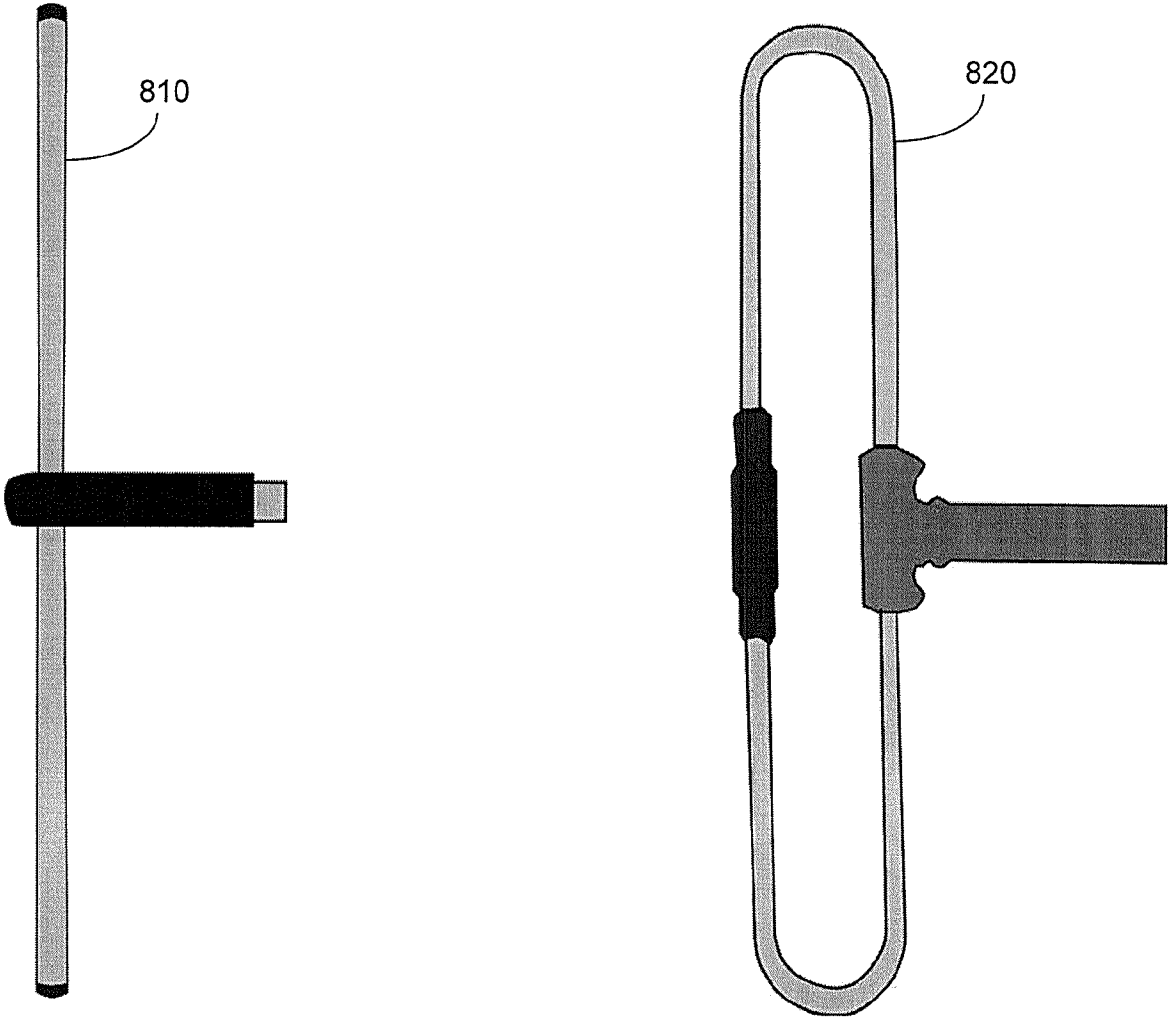
FIG. 8 illustrates different types of dipoles, according to an embodiment of this disclosure.

FIG. 8 illustrates different types of dipoles, according to an embodiment of this disclosure. The embodiments of the dipoles 810, 820 depicted in FIG. 8 are for illustration only. Other embodiments could be used without departing from the scope of this disclosure.

FIG. 8 shows a "stick" dipole 810 and a "folded" dipole 820. Folded dipoles are often used for VHF and UHF communication systems because of their broad band width. Stick dipoles are often used in PTC applications for a number of reasons, as described below. For example, the dipoles shown in FIGS. 1 through 6B may be stick dipoles, such as stick dipole 810.

Stick dipoles are advantageous over folded dipoles in PTC applications for several reasons. The stick dipole substantially reduces wind loading, especially in heavy icing conditions. In icing conditions, the folded dipole may act as a large flat plate with equivalent wind loading characteristics, particularly when ice covers the space inside the folded dipole. Likewise, the stick dipole is significantly lighter in weight, particularly in heavy icing conditions.

A stick dipole provides reduced bandwidth in terms of return loss or VSWR. Thus, frequencies of systems such as the amateur band above 225 MHz are less likely to interfere with the PTC system, thereby making the filtering requirements associated with a stick dipole deployment less significant. Similarly, RF systems using frequencies in a range above 161 MHz and below 220 MHz are less likely to generate interference with the PTC system. At the same time, stick dipoles very adequately cover the narrow bandwidth in the 220-222 MHz and the 160-161 MHz frequency ranges with excellent return loss performance. It is in these two narrow frequency bands that PTC systems (such as those disclosed herein) are licensed by the Federal Communications Commission (FCC) to operate.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. An antenna, comprising:

a mast;

a first radiating array coupled to the mast; and a second radiating array coupled to the mast, wherein each of the first and second radiating arrays comprises a plurality of dipoles associated with a radiation frequency, each dipole coupled to the mast by a standoff, wherein the antenna is part of a Positive Train Control (PTC) system and is disposed in proximity to a train track.

2. The antenna of claim 1, wherein each standoff of the first radiating array is in approximately a same horizontal plane as a corresponding standoff of the second radiating array.

3. The antenna of claim 1, wherein the first radiating array is a 160 MHz array and the second radiating array is a 220 MHz array.

4. The antenna of claim 3, wherein each dipole of the 160 MHz array is positioned from the mast at a distance approximately equal to ¼ wavelength of a 160 MHz signal and each dipole of the 220 MHz array is positioned from the mast at a distance approximately equal to ½ wavelength of a 220 MHz signal.

5. The antenna of claim 4, wherein each dipole standoff of the 160 MHz array is coupled to the mast at an angle between approximately 90 degrees and 180 degrees from each dipole standoff the 220 MHz array.

6. The antenna of claim 1, wherein each dipole standoff is coupled to the mast using at least one band clamp.

7. The antenna of claim 6, wherein at least one dipole standoff is prevented from rotation around the mast by a fastener adjacent to the at least one band clamp.

8. The antenna of claim 1, wherein each dipole comprises a stick dipole oriented in a substantially vertical direction.

9. An antenna, comprising:

a mast;

a 160 MHz array coupled to the mast and comprising a plurality of 160 MHz dipoles coupled to the mast by a standoff; and a 220 MHz array coupled to the mast and comprising a plurality of 220 MHz dipoles coupled to the mast by a standoff, wherein the antenna is part of a Positive Train Control (PTC) system and is disposed in proximity to a train track.

10. The antenna of claim 9, wherein each standoff of the 160 MHz array is in approximately a same horizontal plane as a corresponding standoff of the 220 MHz array.

11. The antenna of claim 9, wherein each 160 MHz dipole is positioned from the mast at a distance approximately equal to ¼ wavelength of a 160 MHz signal and each 220 MHz dipole is positioned from the mast at a distance approximately equal to ½ wavelength of a 220 MHz signal.

12. The antenna of claim 9, wherein each 160 MHz dipole is positioned from the mast at a distance approximately equal to ½ wavelength of a 160 MHz signal and each 220 MHz dipole is positioned from the mast at a distance approximately equal to ½ wavelength of a 220 MHz signal.

13. The antenna of claim 12, wherein each dipole standoff of the 160 MHz array is coupled to the mast at an angle between approximately 90 degrees and 180 degrees from each dipole standoff of the 220 MHz array.

14. The antenna of claim 9, wherein each dipole standoff is coupled to the mast using at least one band clamp.

15. The antenna of claim 14, wherein at least one dipole standoff is prevented from rotation around the mast by a fastener adjacent to the at least one band clamp.

16. The antenna of claim 9, wherein each dipole comprises a stick dipole oriented in a substantially vertical direction.

17. A positive train control system, comprising:

a plurality of antennas positioned along a railroad track; and at least one base station coupled to the antennas, the at least one base station configured to communicate with train equipment and with a remote train monitoring center, wherein each of the antennas comprises:

a mast;

a first radiating array coupled to the mast; and a second radiating array coupled to the mast, wherein each of the first and second radiating arrays comprises a plurality of dipoles associated with a radiation frequency, each dipole coupled to the mast by a standoff.

18. The positive train control system of claim 17, wherein each first radiating array is a 160 MHz array and each second radiating array is a 220 MHz array, wherein each 160 MHz dipole is positioned from the mast at a distance approximately equal to ¼ wavelength of a 160 MHz signal and each 220 MHz dipole is positioned from the mast at a distance approximately equal to ½ wavelength of a 220 MHz signal.

19. The positive train control system of claim 17, wherein each dipole standoff is coupled to the mast using at least one band clamp.

20. The positive train control system of claim 17, wherein each dipole comprises a stick dipole oriented in a substantially vertical direction.

* * * * *